US006844298B2

(12) United States Patent
Prince et al.

(10) Patent No.: US 6,844,298 B2
(45) Date of Patent: Jan. 18, 2005

(54) WATER-SOLUBLE ALUMINIUM AND ALUMINIUM ALLOYS HOT ROLLING COMPOSITION

(75) Inventors: Francis Prince, Le Havre (FR); Jean-Yves Henri Claire, Courdimanche (FR)

(73) Assignee: Mobil Oil Francaise, Courbevoie (FR)

( * ) Notice: Subject to any disclaimer, the term of this patent is extended or adjusted under 35 U.S.C. 154(b) by 17 days.

(21) Appl. No.: 10/182,491

(22) PCT Filed: Feb. 7, 2001

(86) PCT No.: PCT/EP01/01376

§ 371 (c)(1),
(2), (4) Date: Nov. 15, 2002

(87) PCT Pub. No.: WO01/59045

PCT Pub. Date: Aug. 16, 2001

(65) Prior Publication Data

US 2003/0158049 A1 Aug. 21, 2003

(30) Foreign Application Priority Data

Feb. 8, 2000 (EP) ..... 00400342

(51) Int. Cl.[7] ..... C10M 141/02; C10M 129/74

(52) U.S. Cl. ..... 508/209; 508/390; 508/437; 508/485; 508/486; 508/487; 508/488; 508/489; 508/501; 508/579; 72/42

(58) Field of Search ..... 508/501, 485, 508/209

(56) References Cited

U.S. PATENT DOCUMENTS

| | | | | | |
|---|---|---|---|---|---|
| 4,178,260 | A | * | 12/1979 | Cook et al. | 508/162 |
| 4,655,947 | A | * | 4/1987 | Tsai et al. | 508/485 |
| 4,891,161 | A | * | 1/1990 | Tanikawa et al. | 508/501 |
| 5,080,814 | A | * | 1/1992 | Awad | 508/501 |
| 5,114,603 | A | * | 5/1992 | Kennedy et al. | 508/486 |
| 6,054,420 | A | * | 4/2000 | Hartley et al. | 508/485 |
| 6,329,329 | B1 | * | 12/2001 | Sharp et al. | 508/485 |

FOREIGN PATENT DOCUMENTS

| | | | |
|---|---|---|---|
| JP | 49-008004 B | * | 2/1974 |
| JP | 08-170090 A | * | 11/1996 |

* cited by examiner

*Primary Examiner*—Ellen M. McAvoy
(74) *Attorney, Agent, or Firm*—Joseph J. Dvorak

(57) ABSTRACT

The present invention relates to a water-soluble aluminium and aluminium alloys hot rolling composition comprising a base stock oil and, based on the total weight of the composition, from 1 to 80% by weight of a combination of: a monoester of a fatty acid with a polyol and a tetraester of a fatty acid with pentaerythritol; the weight monoester:tetraester ratio of said combination ranging from 1:20 to 10:1. The invention also relates to an oil-in-water emulsion, to a hot rolling process and to the use of the oil-in-water emulsion in a hot rolling process.

13 Claims, 3 Drawing Sheets

Rolling Force as a function of the Pass Number

WATER-SOLUBLE ALUMINIUM AND ALUMINIUM ALLOYS HOT ROLLING COMPOSITION

The present invention relates to a water-soluble aluminium and aluminium alloys hot rolling composition and to a process for hot rolling aluminium and aluminium alloys.

The aluminium and aluminium alloys rolling industry expresses the need to maximize the efficiency of their rolled metal manufacturing process. In general terms, this means that there is a wish to operate at higher rolling speeds and to produce more marketable products per operating shift. Additionally, there is also a wish to minimize the number of passes through the mill taken to achieve a given level of reduction. Both these routes require that quality and surface finish be not compromised.

The invention thus provides an oil composition for hot rolling mills that affords the following customer benefits:

- a higher reduction ratio: one pass reduction is in most cases achievable;
- a better rolling ability (i.e. a lower rolling force and a reduced power consumption) as compared to the rolling ability obtained with oil compositions of the prior art;
- an improved rolled surface finish quality;
- an easier emulsion maintenance: a better pH control, improved oxidation stability and resistance to bacteria; and
- a lower oil consumption.

The invention is effective on any type of hot rolling, be it reversible or not, on breakdown, tandem and combination mills.

Especially, the invention exhibits high reduction and rolling capabilities while providing an excellent strip surface finish when rolling at high speed.

The prior art does not teach or even suggest the instant invention.

Thus, the invention provides a water-soluble aluminium and aluminium alloys hot rolling oil composition comprising a base stock oil and, based on the total weight of the composition, from 1 to 80%, preferably from 1 to 30% by weight of a combination of:

a monoester of a fatty acid with a polyol and a tetraester of a fatty acid with pentaerythritol;

the weight monoester:tetraester ratio of said combination ranging from 1:20 to 10:1, and preferably from 1:10 to 5:1.

According to one embodiment, the oil composition further comprises, based on the total weight of the composition, from 0.1 to 20% of a mixture of ethoxylated alcohols (having from 5 to 15 carbons atoms and preferably from 12 to 15 carbon atoms). As an example of such a mixture, a mixture of ethoxylated alcohols sold by ICI under tradenames Synperonic® A7 and Hypermer® A60 can be used, the Synperonic® A7:Hypermer® A60 weight ratio preferably ranging from 1:10 to 10:1.

According to a further embodiment, the oil composition further comprises, based on the total weight of the composition, from 1 to 30%, preferably from 5 to 20% by weight of oleic acid. It is actually believed that the free oleic acid provides a better surface finish to the aluminium or aluminium alloy strip.

The invention further provides a process for preparing the oil composition.

The invention further provides an emulsion containing the oil composition and a process for preparing this emulsion.

In addition, the invention provides the use of the oil composition of the invention to prepare emulsions intended to be used in a aluminium or aluminium alloy hot rolling process.

The invention also provides a process for hot rolling aluminium and aluminium alloys sheets, comprising applying an effective amount of the emulsion of the invention.

Finally, the invention provides the use of the emulsion in a hot rolling process.

The invention is now disclosed in more details in the following specification and in reference to the drawings in which.

Figure 1:
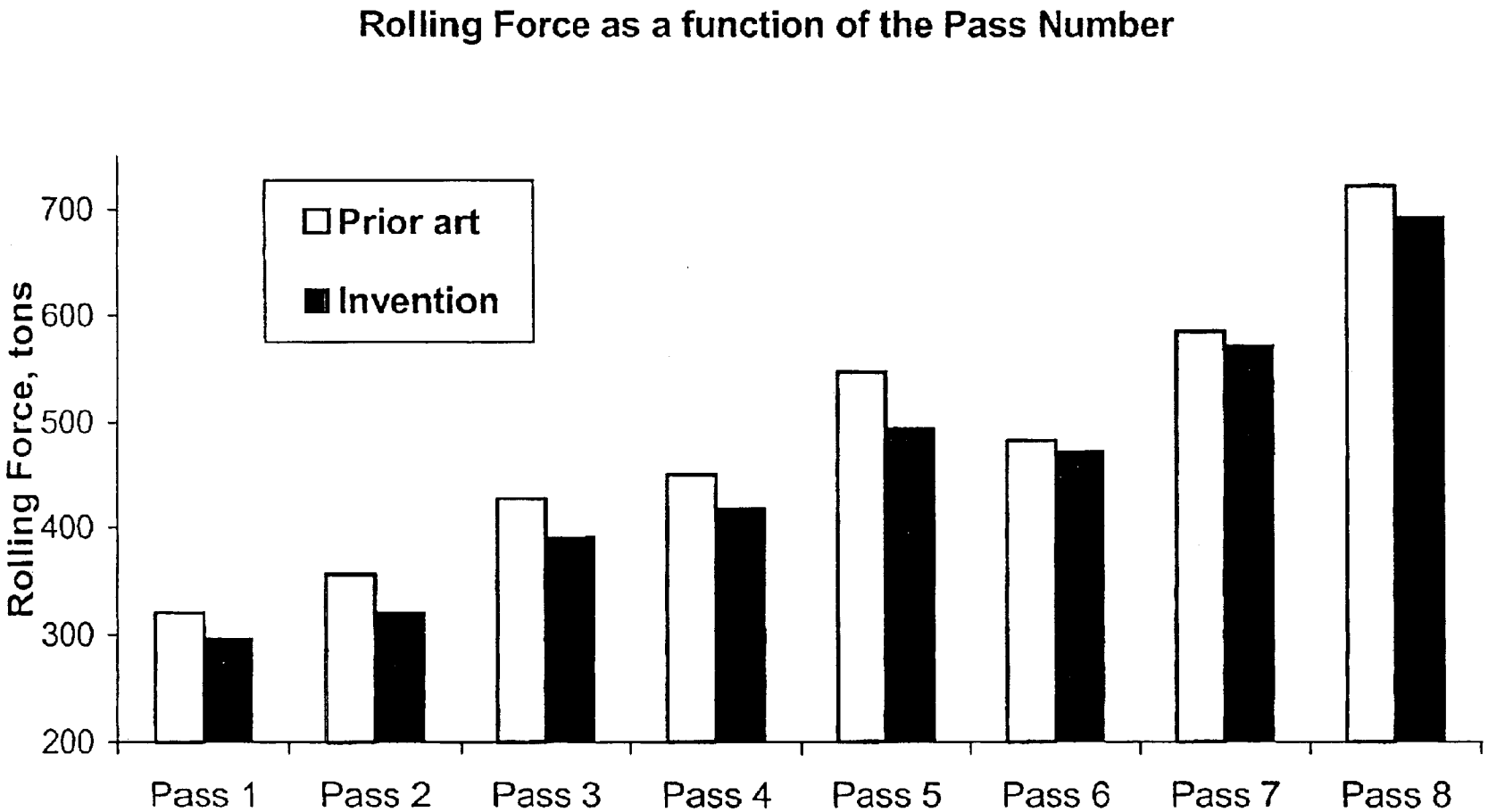
FIG. 1 is a graph showing the applied rolling force versus the number of passes, first, when an emulsion of the prior art and then when an emulsion of the invention are used.

The oil compositions of the invention are neat oil concentrates generally intended to be diluted in water to give oil-in-water emulsions.

The base stock oil is any oil typically used in the field of hot rolling. It can be paraffinic or naphthenic.

Paraffinic base oils are made from crude oils that have relatively high alkane contents (high paraffin and isoparaffin contents). Typical crudes are from the Middle East, North Sea, US mid-continent. The manufacturing process requires aromatics removal (usually by solvent extraction) and dewaxing. Paraffinic base oils are characterized by their good viscosity/temperature characteristics, i.e. high viscosity index, adequate low-temperature properties and good stability. They are often referred to as solvent neutrals, where solvent means that the base oil has been solvent-refined and neutral means that the oil is of neutral pH. An alternative designation is high viscosity index (HVI) base oil. They are available in full range of viscosities, from light spindle oils to viscous brightstock.

Naphthenic base oils have a naturally low pour point, are wax-free and have excellent solvent power. Solvent extraction and hydrotreatment can be used to reduce the polycyclic aromatic content.

A preferred base oil is a hydrotreated naphthenic oil.

The base oil typically has a viscosity from 7 to 150 cSt at 40° C., preferably from 20 to 50 cSt at 40° C.

In the combination of the mono and tetra esters, the fatty acid of the monoester has from 16 to 20 carbon atoms and preferably is oleic acid. The polyol of the monoester is preferably glycerol.

The fatty acid of the tetraester has from 16 to 20 carbon atoms and preferably is oleic acid.

The water-soluble oil composition preferably comprises a trialkanolamine ($C_{2-4}$), preferably triethanolamine, the amount of which being such that all bindable trialkanolamine is bound to a part only of the oleic acid. The aim of this embodiment is to ensure that there remains free oleic acid in the oil composition.

The product of the reaction of the trialkanolamine with oleic acid acts as a surfactant.

The oil composition may comprise classical additives, such as surfactants, coupling agents or cosurfactants, friction reducing agents or lubricity agents, corrosion inhibitors or anti-oxidants, extreme-pressure and anti-wear agents, bactericides and fungicides, anti-foaming agents, anti-rust agents.

However, an important feature of the invention is that the oil composition, and therefore also the emulsion, do not comprise nonyl-phenol surfactants, which are considered to raise environment problems.

Examples of anti-foaming agents are silicone based, especially polydimethylsiloxane.

Examples of corrosion inhibitors are hindered phenols and zinc dialkyldithiophosphates (ZDDP).

Examples of extreme-pressure and anti-wear agents are dilauryl phosphate, didodecyl phosphite, trialkylphosphate such as tri(2-ethylhexyl)phosphate, tricresylphosphate (TCP), zinc dialkyl(or diaryl)dithiophosphates (ZDDP), phosphosulphurized fatty oils, zinc dialkyldithiocarbamate), mercaptobenzothiazole, sulphurized fatty oils, sulphurized terpenes, sulphurized oleic acid, alkyl and aryl polysulphides, sulphurized sperm oil, sulphurized mineral oil, sulphur chloride treated fatty oils, chlornaphta xanthate, cetyl chloride, chlorinated paraffinic oils, chlorinated paraffin wax sulphides, chlorinated paraffin wax, and zinc dialkyl (or diaryl)dithiophosphates (ZDDP), tricresylphosphate (TCP), trixylylphosphate (TXP), dilauryl phosphate, respectively.

Examples of corrosion inhibitors or anti-oxidants are radical scavengers such as phenolic antioxidants (sterically hindered), aminic antioxidants, organo-copper salts, hydroperoxides decomposers, butylated hydroxytoluene.

Examples of anti-rust agents are amine derivative of alkenyl succinic anhydride.

Further elements on base oils and additives can be found in "Chemistry And Technology Of Lubricants", R. M. Mortier and S. T. Orszulik, VCH Publishers, Inc, 1992.

The following is an example of content of the water-soluble oil composition of the invention (the percentages are weight percentages based on the total weight of the composition):

0.1–1.0% of trialkyl($C_{1-4}$) phenol;

0.5–4.0% of trialkyl ($C_{3-10}$) phosphate ester;

1–4% of petroleum sulfonate;

0.1–10% of organic fatty acid ($C_{16-20}$);

0.1–0.5% of amino alkyl ($C_{2-4}$) alkanediol ($C_{2-5}$);

1–4% of trialkanol ($C_{2-4}$) amine;

2–10% of a glycerol mono fatty acid ($C_{16-20}$) ester;

5–15% of pentaerythritol tetra fatty acid ($C_{16-20}$) ester;

0.5–1.0% of 5-carboxy 4-hexyl 2-cyclohexen 1-octanoic acid;

3–6% of a mixture of ethoxylated alcohols ($C_{5-15}$, comprising 2–10 $CH_2O$ groups);

0.05–0.4% of a siloxan based polymer;

the balance being a mixture of naphthenic lube base oils.

The oil composition is prepared by blending the base oil and the other ingredients under stirring or with any mixing device, preferably whilst controlling the temperature so that is does not exceed 50° C., and more preferably 45° C.

An oil-in-water emulsion is prepared by diluting under stirring the oil composition of the invention in water. It is preferred to use deionized water, which may previously have been warmed to around 35° C.

The emulsion generally comprises water and, based on the total volume of the emulsion, from 0.5 to 30%, preferably from 1 to 20%, by volume, of the oil composition.

The aluminium alloys to which the invention applies are any aluminum alloys, including the 1000, 2000, 3000, 5000, 6000 and 7000 series.

The hot rolling process can be the classical process. The rolled metal temperature is generally around 600–650° C. on a breakdown mill and around 400–450° C. on a tandem mill.

The process is preferably carried out on a breakdown reversible mill. The instant oil-in-water composition allows a significant reduction of the number of passes. With conventional prior art emulsions, the number of passes was typically 13. The emulsion of the invention allows lowering this number by 2 passes, which is a significant improvement.

The following examples illustrate the invention without limiting it. All parts and ratios are given by Weight, unless otherwise stated.

EXAMPLE

A composition is prepared by mixing the ingredients of Table 1 in the order in which they appear in this table. The temperature is be maintained at a maximum of 50° C. to ensure a complete dissolution and homogeneisation of the ingredients without impairing the properties of the emulsion.

TABLE 1

| Ingredients | Content (wt %) |
|---|---|
| Hydrotreated naphthenic base oil (20 cSt at 40° C.) | 31.30 |
| Hydrotreated naphthenic base oil (110 cSt at 40° C.) | 36.65 |
| Polydimethylsiloxane dispersed silica compound (defoamant) | 0.10 |
| Di-tertiobutyl paracresol (antioxidant) | 0.20 |
| Trioctylphosphate ester (extreme pressure agent) | 3.00 |
| Petreoleum sulfonate (surfactant) | 2.80 |
| Oleic acid (lubricity agent/cosurfactant) | 5.00 |
| Aminoethylpropanediol (buffer) | 0.30 |
| Triethanolamine (cosurfactant) | 2.00 |
| Glycerol monooleate ester (lubricity agent) | 5.00 |
| Pentaerythritol tetraoleate ester | 8.40 |
| 5-carboxy 4-hexyl 2-cyclohexen 1-octanoic acid (corrosion inhibitor) | 0.70 |
| Ethoxylated alcohols* (surfactants) | 4.50 |

*mixture of $C_{12-15}$ alcohols:
sold by ICI under the tradename Synperonic A47: 0.6%
ethylene oxide addition polymer sold by ICI under the tradename Hypermer A60: 3.90%

The characteristics of the composition of Table 1 are set out in Table 2.

TABLE 2

| Oil concentrate before dilution | Unit | Method | Typical characteristics |
|---|---|---|---|
| Colour (ASTM) | | ISO 2049 | L 2.0 |
| Density at 15° C. | g/ml | ASTM D 1298 | 0.9231 |
| Pour point | ° C. | ISO 3016 | −24 |
| Viscosity at 40° C. | cSt | ASTM D 445 | 49 |
| Neutralization number | KOH mg/g | ASTM D 974 | 12.3 |
| Saponification number | KOH mg/g | ASTM D 94 | 36.2 |
| Total base number | KOH mg/g | ISO 3771 | 8.9 |

An emulsion is prepared by diluting under stirring the oil composition of Table 1 in deionized water prewarmed to 35° C. The characteristics of the obtained emulsion are given in Table 3.

TABLE 3

| Emulsion | Method | Typical characteristics |
|---|---|---|
| Stability of the 6% (v/v) emulsion (at room temperature, for 20 hours) | Mobil[1)] | 2.0% cream |

TABLE 3-continued

| Emulsion | Method | Typical characteristics |
|---|---|---|
| pH value of fresh 5% (v/v) emulsion at 20° C. | ASTM E 70–90 | 8.4 |

[1)]The emulsion stability was determined according to the following procedure. 470 ml of distilled water at room temperature or test temperature were measured into a 800-ml beaker. A 50-ml stirrer having four paddles was attached to a stirring motor so that the paddles were positioned 25 mm above the bottom of the beaker. A 50-ml dropping funnel was positioned such that the outlet was 15 mm from the beaker wall.

The stirrer was turned on and the rate adjusted to 1000 rpm. The sample was then heated up to a temperature of 35±1° C. 30 ml of the test oil were added to the dropping funnel. The dropping rate was adjusted such that all the oil was transferred to the water within 120±20 seconds. The stirring was then continued for an additional 60 seconds while the sample temperature was maintained at 35°±1° C. The resulting emulsion was poured into a 500-ml graduated cylinder and allow to stand at room temperature for 20 hours. After 20 hours, the upper layer (yellow cream+oil) was read in volume percent.

Experimental Testing

A blank is first prepared by diluting a prior art oil composition which has the composition set out in Table 4:

TABLE 4

| Ingredients | Content (wt %) |
|---|---|
| Naphthenic base oil (100 cSt at 40° C.) | 39.0 |
| Naphthenic base oil (22 cSt at 40° C.) | 36.0 |
| Tap water | 0.5 |
| Petreoleum sulfonate | 3.0 |
| Amino ethyl alkanediol ($C_3$ to $C_6$) | 0.3 |
| Trioctyl phosphate ester | 3.0 |
| Trialkanol amine ($C_2$ to $C_4$) | 1.0 |
| 5-carboxy 4-hexyl 2-cyclohexen 1-octanoic acid | 0.7 |
| Ethoxylated nonylphenol (5 ethylene oxide groups) | 0.7 |
| Ethoxylated nonylphenol (10 ethylene oxide groups) | 2.4 |
| Alkanol[(*)] oleic acid ester ($C_2$ to $C_{12}$) | 13.4 |

[(*)]the alkanol is a mixture of glycerol and pentaerythritol

Two emulsions are prepared by respectively diluting the oil compositions of the invention and of the prior art in dionized water.

Both emulsions are evaluated on an industrial test mill. The rolling conditions were as follows:

mill type: 2 high motor output: 45 kW or 67 kW roll diameter: 760 mm roll hardness: 58–61 Rockwell C maximal width of metal: 685 mm typical width of metal: 305 mm maximum speed: 30 m/min entrance temperature (ingot): 450° C.

ingot dimensions: 305×610×1650 mm final thickness: 25.4 mm emulsion volume 400 l emulsion temperature: 50° C.

emulsion concentration: 5%

The following procedure was used with each oil in the rolling tests:

1. The AA5182 blocks were lightly scalped, degreased with methyl ethyl ketone and heated to 454° C.
2. The mill rolls were washed in a dilute solution of sodium hydroxide to remove the roll coating from any previous rolling and then rinsed. The rinse water was checked for residual caustic. A profilometer was used to measure surface roughness.
3. The rolls were preheated to 77° C. using quartz-tube heaters.
4. The coolant sprays were adjusted to give a flow of 200 l/min with a pressure of 6.9. $10^4$ Newton/sq. meter (10 psig) on the top spray header, and 4.1 $10^5$ Newton/sq. meter (60 psig) on the bottom header.
5. A 100 cm (4-inch) thick block of AA5182 was given 5 rolling passes using the following nominal pass schedule. Mill speed was 18.3 m/min. All passes were in the east to west rolling direction. The mill gap setpoints were recorded for the first emulsion tested and then duplicated for the remaining emulsions. These settings were 1.27 mm below the nominal desired exit thickness on each pass.

Nominal Pass Schedule:

| | |
|---|---|
| Pass 1 | 100 mm–83 mm |
| Pass 2 | 83 mm–65 mm |
| Pass 3 | 65 mm–50 mm |
| Pass 4 | 50 mm–37 mm |
| Pass 5 | 37 mm–25 mm |

6. A 600 mm long piece of metal was sheared from the mid-length of the 25 mm thick piece to be used later for anodizing. The two remaining pieces were put back into the furnace for reheating.
7. A second block was given the same treatment as indicated in items 5 and 6. Oil concentrate was added to the emulsion to obtain a 7% volume concentration.
8. The two pieces from each of the original blocks were then rolled after reheating at a mill speed of 18.3 m/min using the following nominal pass schedule:

| | |
|---|---|
| Pass 6 | 25 mm–16 mm |
| Pass 7 | 16 mm–9.5 mm |
| Pass 8 | 9.5 mm–5 mm |

9. After the last pass, two 600 mm long pieces were hot sheared from each of the pieces rolled. This metal was saved for later inspection in the as-rolled and anodized condition. The distance between two marks scribed on the roll was measured on the strip surface following the last pass for use in calculating forward slip.
10. The top work roll was then sampled via caustic extraction of a known area for the later measurement of the aluminium deposited on it.

A roll coating measurement was carried out as follows.

1. A plexiglass, gasketed fixture was attached and sealed to the center of the top work roll. This fixture includes a reservoir covering an area of 20.26 square centimeters of the roll surface.
2. Fifteen milliliters of 1N sodium hydroxide was syringed into the reservoir where it was permitted to react with the aluminum roll coating on the roll surface for approximately 5 minutes.
3. The caustic liquor was then extracted via syringe from the reservoir and placed into a sample bottle.

4. Two 15 ml rinses with deionized water were applied, extracted with a syringe and added to the sample bottle.
5. Total aluminum in the sample was determined via ICP.
6. The roll coating weight was then calculated and expressed as milligrams of aluminum per square centimeter of roll surface.

The roll coating was found to be better with the invention than with the emulsion of the prior art.

FIG. 1 is a graph showing the applied rolling force (in tons) applied on an aluminium alloy AA5182 versus the number of passes.

As can be seen, an improvement of 6.4% on average is achieved with the emulsion of the invention over the emulsion of the prior art.

Figure 2:
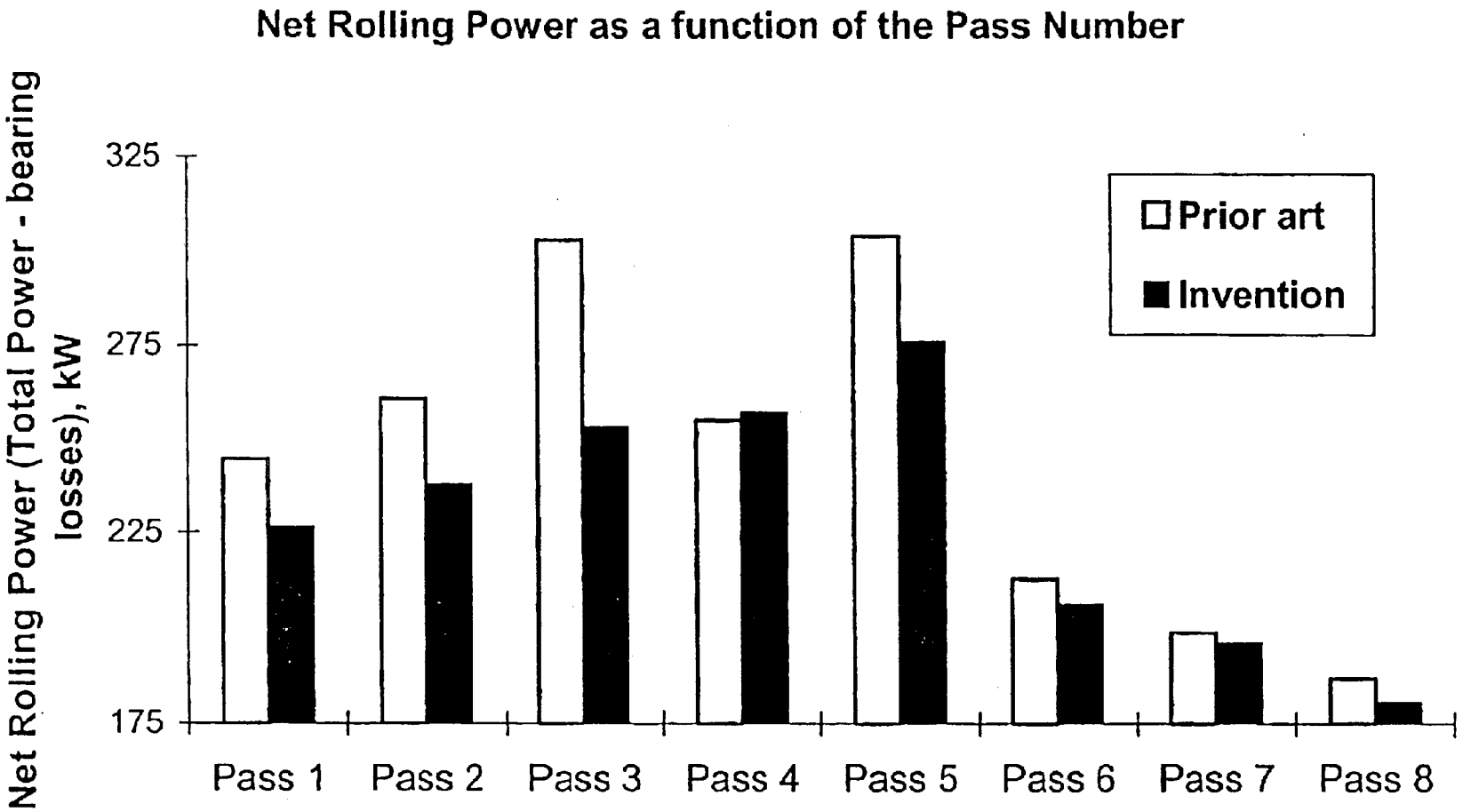
FIG. 2 is a graph showing the applied net rolling power versus the number of passes, first, when an emulsion of the prior art and then when an emulsion of the invention are used.

FIG. 2 is a graph showing the applied net rolling power (total power minus bearing losses, in kW) versus the number of passes.

An improvement of 6.0% on average is achieved with the emulsion of the invention over the emulsion of the prior art.

The plate-out properties of both emulsions were also determined. The oil plate-out property of an emulsion is herein defined as the property of the film to separate out from an emulsion onto the aluminium surface. The greater the formation of a film oil on the aluminium surface, the higher the lubricity and the better the roll coating.

The plate-out property is determined as follows. A preheated aluminium sheet is submerged in an emulsion for a given time and then positioned at 40° angle. After drying in an oven, the amount of deposited oil is calculated from the weight difference of the aluminium sheet.

A value of 650 $mg/m^2$ was found for the prior art emulsion whereas a value of 1150 $mg/m^2$ was found for the emulsion of the invention. Therefore, the higher value obtained for the plate-out property of the emulsion of the invention reflects its better lubricity over the prior art emulsion.

The quenching effect of an emulsion is defined as its ability to remove heat. The heat transfer from the aluminium surface to the emulsion therefore depends on the emulsifier system as well as on the emulsion concentration.

As a result, it is aimed at achieving the highest possible vaporization temperature in order to improve the heat removal and thus obtain a better cooling.

The vaporization temperature of both the emulsion of the prior art and the emulsion of the invention were measured using a METTLER FP-82HT HOT STAGE commercially available from Mettler Toledo. A sample of an aqueous emulsion containing an oil composition is sandwiched between glass plates located between two heaters, which are maintained at the same temperature. The temperature of the sample is remote-controlled and the motion of the emulsion is observed via a polarizing microscope or transmission microscope. At a certain temperature, the emulsion no longer maintains the status that the oil droplets are dispersed in water, and the emulsion system collapses transiently. The change of the dispersion system observed by the microscope is recorded as the vaporisation temperature of the system.

Figure 3:
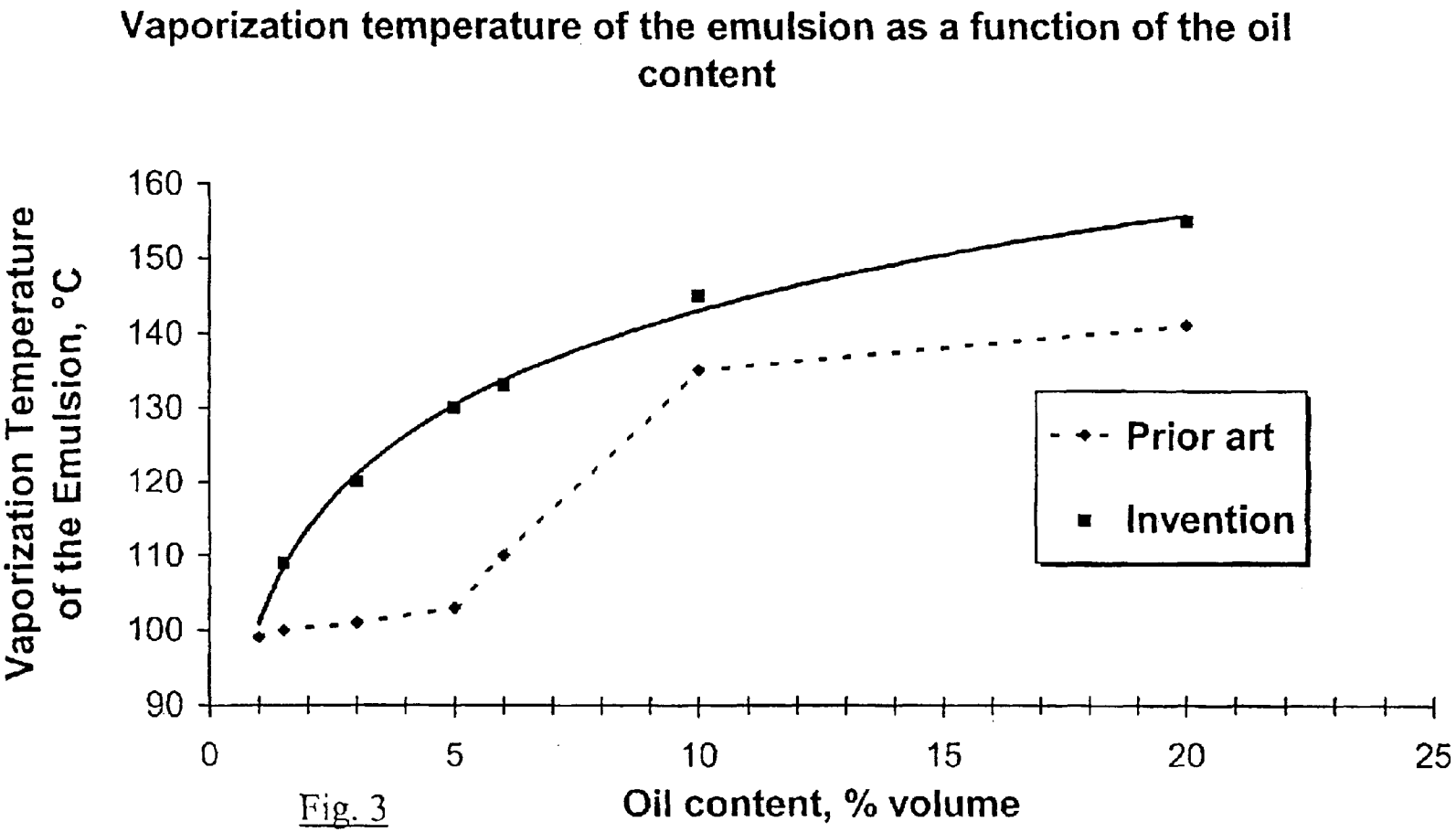
FIG. 3 shows curves representing the vaporization temperatures of an emulsion of the invention and an emulsion of the prior art versus the oil content of the respective emulsions.

The vaporization temperatures are plotted against the oil contents of the tested emulsions. FIG. 3 shows the obtained corresponding curves.

It results from FIG. 3 that at a 6% oil concentration, the water phase of the emulsion of the invention vaporizes at 130° C. whereas the water phase of the emulsion of the prior art vaporizes at 103° C. Therefore, the vapor phase between the roll and the coolant is significantly reduced with the emulsion of the invention, which enables a higher heat transfer.

Higher thermal conductivity of the vapor phase and enthalpy of the liquid phase are obtained with the emulsion of the invention. In order words, when using the emulsion of the invention, a better cooling ability is achieved and therefore the oil consumption is lower.

What is claimed is:

1. Water-soluble aluminum and aluminum alloys hot rolling oil composition comprising a base stock oil and, based on the total weight of the composition, (a) from 1 to 80% by weight of a combination of:

a monoester of fatty acid with a polyol and a tetraester of a fatty acid with pentaerythritol; the weight monoester:tetraester ratio of said combination ranging from 1:20 to 10:1; and (b) from 0.2 to 30% of a mixture of ethoxylated alcohols having from 5 to 25 carbon atoms.

2. Water-soluble oil composition according to claim 1 comprising, based on the total weight of the composition, from 3 to 30% by weight of said combination.

3. Water-soluble oil composition according to claims 1 or 2, wherein the weight monoester:tetraester ratio ranges from 1:10 to 5:1.

4. Water-soluble oil composition according to claim 3, wherein the fatty acid of the monoester has from 16 to 20 carbon atoms.

5. Water-soluble oil composition according to claim 4, wherein polyol of the monoester is glycerol.

6. Water-soluble oil composition according to claims 1 or 5, wherein the fatty acid of the tetraester has from 16 to 20 carbon atoms.

7. Water-soluble oil composition according to claims 1 or 2, further comprising, based on the total weight of the composition, from 1 to 30% oleic acid.

8. Water-soluble oil composition according to claim 7, further comprising, a trialkanolamine ($C_{2-4}$) in such an amount that all bindable trialkanolamine is bound to a part of the oleic acid.

9. Water-soluble oil composition according to claim 1, comprising (in weight percentages based on the total weight of the composition):

0.1–1.0% of trialkyl ($C_{1-4}$) phenol;

0.5–4.0% of trialkyl ($C_{3-10}$) phosphate ester;

1–4% of petroleum sulfonate;

0.1–10% of organic fatty acid ($C_{16-20}$);

0.1–0.5% of amino alkyl ($C_{2-4}$) alkanediol ($C_{2-5}$);

1–4% of trialkanol ($C_{2-4}$) amine;

2–10% of glycerol mono fatty acid ($C_{16-20}$) ester;

5–15% of pentaerythritol tetra fatty acid ($C_{16-20}$) ester;

0.5–1.0% of 5-carboxy 4-hexyl 2-cyclohexen 1-octanoic acid;

0.05–0.4% of siloxan based polymer; wherein the base oil stock is a mixture of naphthenic lube base oils.

10. Water-soluble oil composition according to claim 8 in which the base stock oil has a viscosity comprised between 7 and 150 cSt at 40° C.

11. In the hot rolling process for rolling aluminum and aluminum alloy sheets wherein an oil-in-water emulsion is employed, the improvement comprising using as the oil-in-water emulsion one comprising water and from 0.5 to 30 vol % of an oil composition comprising a base stock oil and, based on the total weight of the oil composition:

(a) from 1 to 80 wt % of a combination of a monoester of a fatty acid with a polyol and a tetraester of a fatty acid with pentaerythritol, the weight ratio of monoester to tetraester being in the range of 1:20 to 10:1, and (b) from 0.1 to 20 wt % of a mixture of ethoxylated alcohols having from 5 to 15 carbon atoms.

12. The improvement of claim 11 wherein the oil composition further comprises 1 to 30 wt % of oleic acid.

13. The improvement of claim 12 wherein the oil composition further comprises a trialkanolamine in an amount sufficient that all bindable trialkanolamine is bound to a part of the oleic acid.

* * * * *